US005826390A

United States Patent [19]

Sacks

[11] Patent Number: 5,826,390

[45] Date of Patent: Oct. 27, 1998

[54] BUILDING WALL MEMBRANE

[75] Inventor: Abraham Sacks, Vancouver, Canada

[73] Assignee: Sacks Industrial Corp., Vancouver, Canada

[21] Appl. No.: 654,257

[22] Filed: May 28, 1996

[51] Int. Cl.[6] ..... E04B 1/70

[52] U.S. Cl. ..... 52/408; 52/302.1; 52/409; 52/413; 52/783.11; 52/789.1; 52/793.11

[58] Field of Search ..... 52/783.17, 789.1, 52/791.1, 793.1, 793.11, 800.1, 801.11, 801.11, 783.1, 302.1, 408, 409, 413, 749.15, 783.11

[56] References Cited

U.S. PATENT DOCUMENTS 1,426,872 8/1922 Hummert ..... 52/783.17 X 1,774,860 9/1930 Wendler et al. ..... 52/791.1 X 2,419,971 5/1947 Rumpf et al. ..... 52/791.1 X 3,196,763 7/1965 Rushton ..... 52/789.1 X 4,078,350 3/1978 Ting ..... 52/783.1 X

*Primary Examiner*—Christopher Kent

*Attorney, Agent, or Firm*—Anderson, Levine & Lintel

[57] ABSTRACT

A vapor permeable prefabricated membrane for use in an exterior wall or party wall of a building, which has passageways formed when the membrane is in place in the wall extending from a region near a top of the wall to a bottom thereof. The passageways permit the escape of trapped moisture.

13 Claims, 11 Drawing Sheets

BUILDING WALL MEMBRANE

FIELD

The present invention relates to a membrane for use in the construction of exterior walls primarily but not limited to residential buildings. The purpose of the membrane is to provide escape passageways for moisture that penetrates the building wall envelope so as to prevent damage caused by any such moisture that enters and becomes entrapped in the wall.

BACKGROUND

A typical residential exterior wall structure consists of a plurality of regularly spaced apart vertical studs that rest on the perimeter of a floor and extend up to a horizontal plate that interconnects the tops of the studs. Sheathing or, in some cases, rigid insulation board is affixed to the exterior surfaces of the studs and insulation is placed between the studs abutting the sheathing. A vapor barrier of polyethylene sheet is attached to the interior surfaces of the studs covering the insulation and finished wallboard is affixed over the vapour barrier. A vapour permeable sheet such as building paper is attached to the sheathing. Over the building paper there is affixed an exterior wall finish such as siding or stucco and wire mesh. When moisture penetrates such a wall through cracks in the stucco, splits in the siding or around windows and doors it may become trapped with a limited or no avenue of escape due to the tight juxtaposition of the sheathing, vapor permeable sheet, and exterior wall finish. Such trapped water in time causes rotting of the sheathing and siding or deterioration of the stucco and the structural system. Such damage is one of the major concerns of the building industry. This type of damage is usually expensive to repair and often extensive in nature.

Accordingly, it is an object of the invention to provide an improved membrane for the exterior of building walls which allows moisture to escape easily without the necessity of separately installing spacers or channels on the wall.

SUMMARY OF THE INVENTION

According to the invention there is provided a vapour permeable prefabricated membrane for use in an exterior wall of a building, which has a sheet of vapour permeable material and a plurality of furring spacers on the sheet. When the furring spacers abut a flat surface in the exterior wall, passageways are formed between the sheet of material and the surface which the spacers abut so as to permit the escape of any moisture which penetrates the exterior wall and avoids trapping of that moisture and the damage consequent therefrom. The passageways may be preformed in the membrane itself or may be formed between the membrane and an adjacent flat surface.

The spacers may be elements separately affixed to the membrane such as discs or elongated strips.

Alternatively, the spacers may be depressions in the membrane. The depressions may be elongated trench depressions or dimples.

The spacers may be selected from the group consisting of a mesh and a web. The mesh or web may be in the form of a unitary sheet or may be formed from individual spacer elements that are joined together to form the mesh or web. In either case the mesh or web is formed so that they provide a plurality of passageways that permit the relatively free flow of water once the mesh or web is affixed to a vapour permeable sheet.

In an alternative embodiment of the invention there is provided a permeable membrane for use in an exterior wall of a building which includes a sheet material corrugated so that when abutting a flat surface, elongated passageways are formed which permit the escape of moisture penetrating the wall.

In yet another alternative embodiment of the invention there is provided a vapour permeable membrane for use in the exterior wall of a building having two spaced apart sheets of vapour permeable sheets, incorporating integral spacers, creating internal elongated passageways therebetween.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
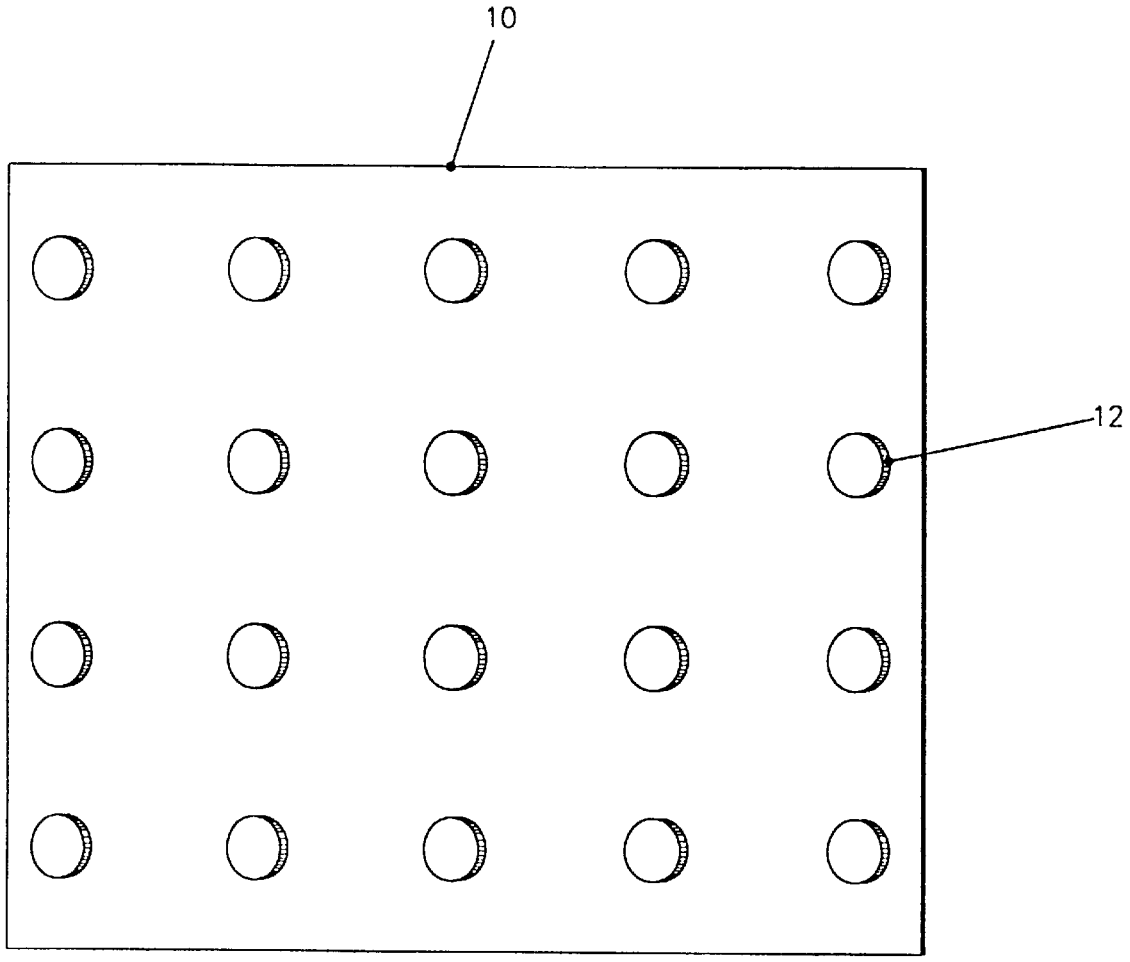
FIG. 1 is a perspective view of a portion of a sheet of building paper having spacers in the form of discs attached to the membrane.
Figure 2:
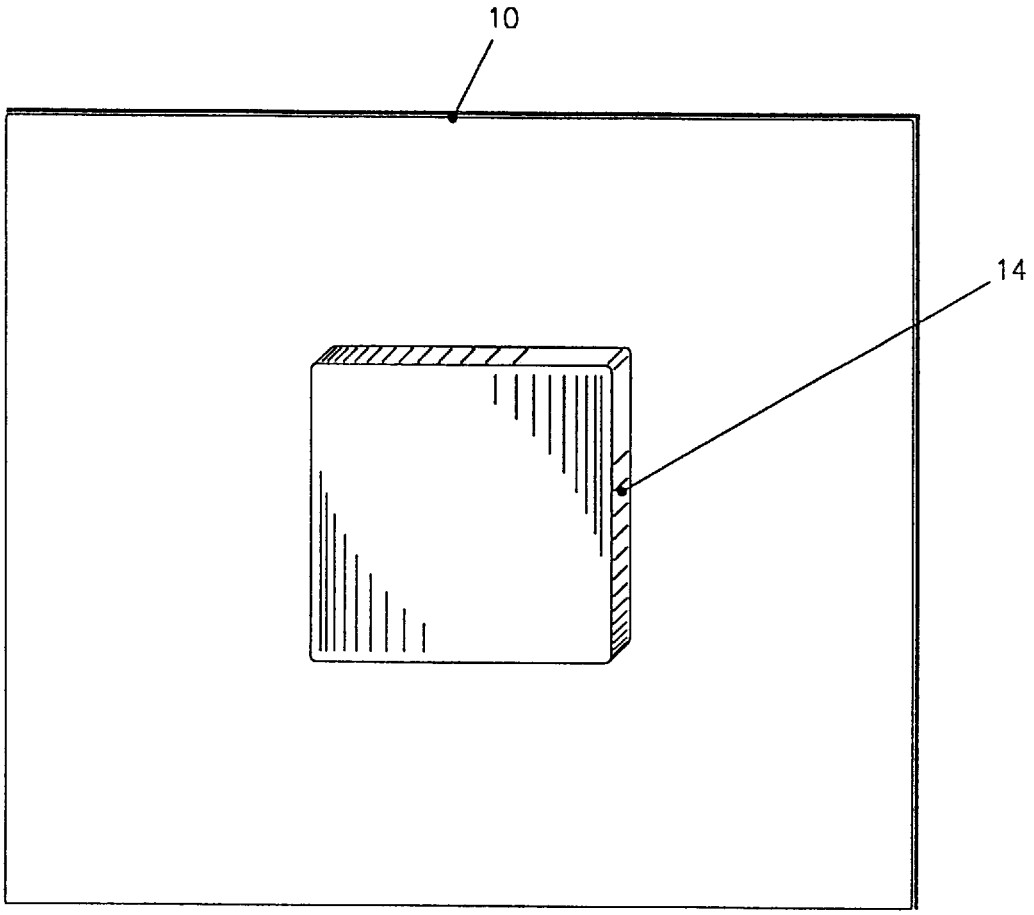
FIG. 2 is a perspective view of a portion of a membrane showing one of many square discs rather than the round discs of FIG. 1.

Referring to FIG. 1 a membrane 10 such as vapour permeable building paper has attached at regular intervals both along the length and perpendicular to the length discs which are both round 12 and, as shown in FIG. 2, square 14. The thickness of the spacers is selected for the particular application but can be from about 1 mm up to about 25 mm.

Figure 3:
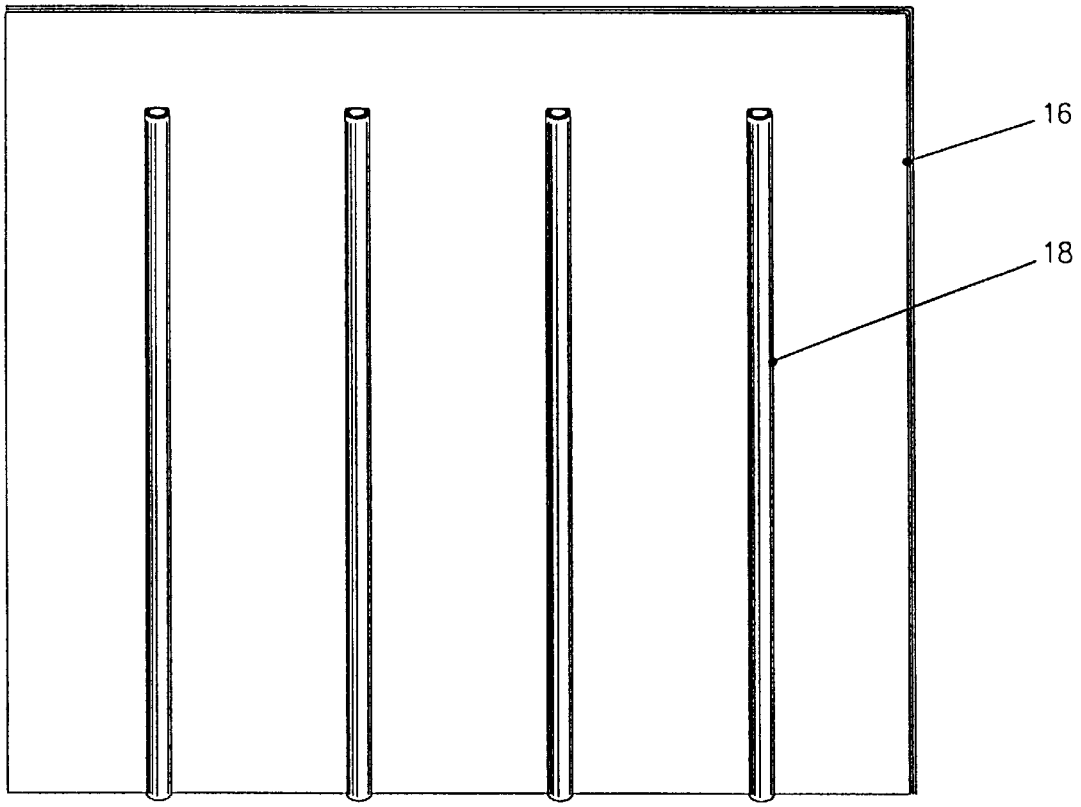
FIG. 3 is a perspective view of a portion of a sheet of building membrane having elongated strips attached thereto.
Figure 4:
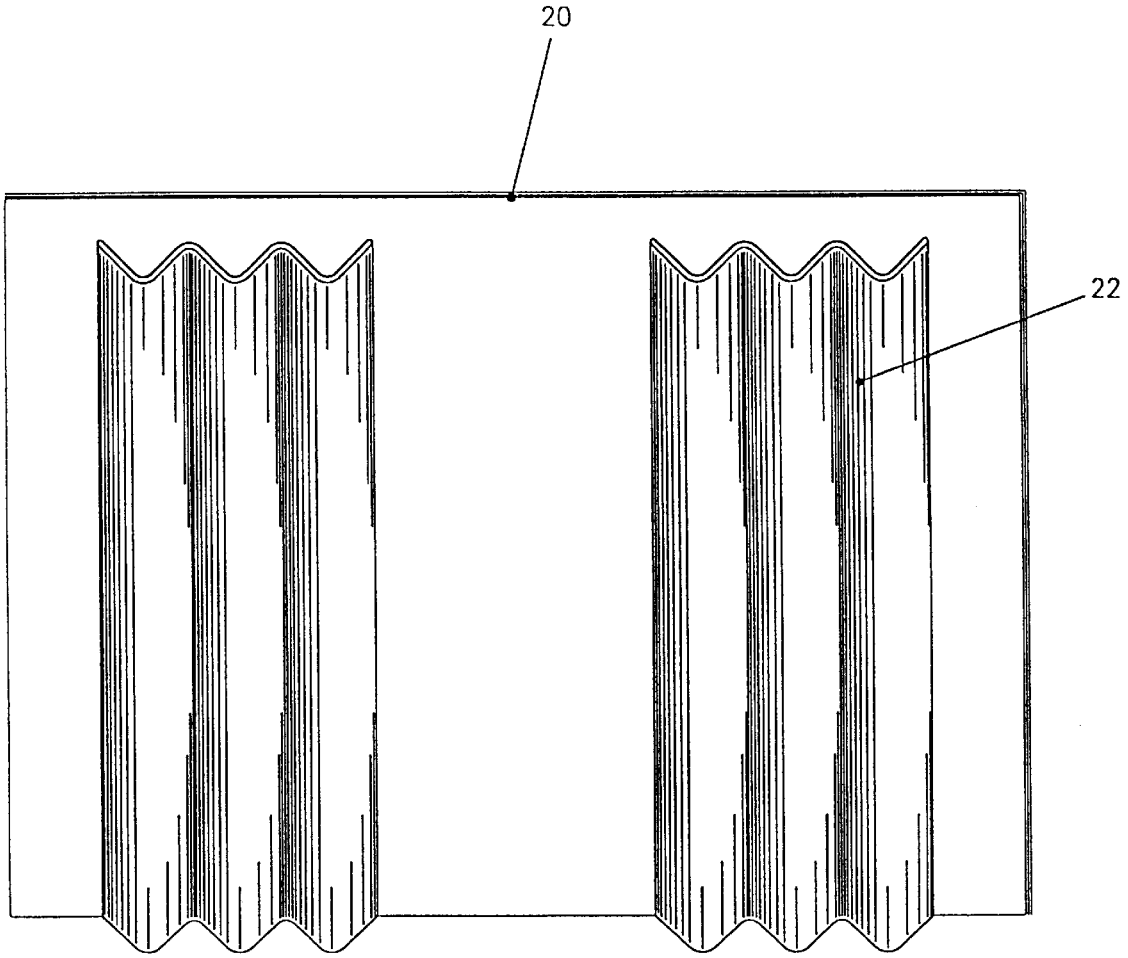
FIG. 4 is a perspective view of a portion of a sheet of building membrane having bellows shaped elongated spacers attached thereto.
Figure 5:
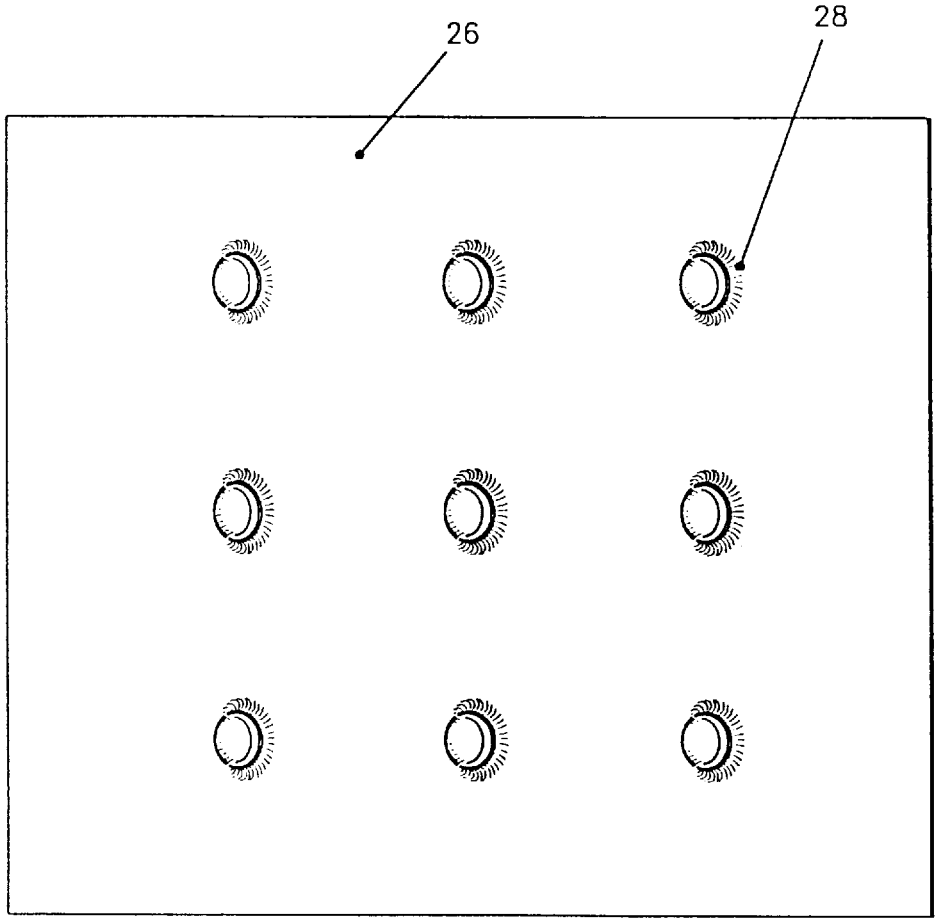
FIG. 5 is a perspective view of a dimpled sheet of building membrane.
Figure 6:
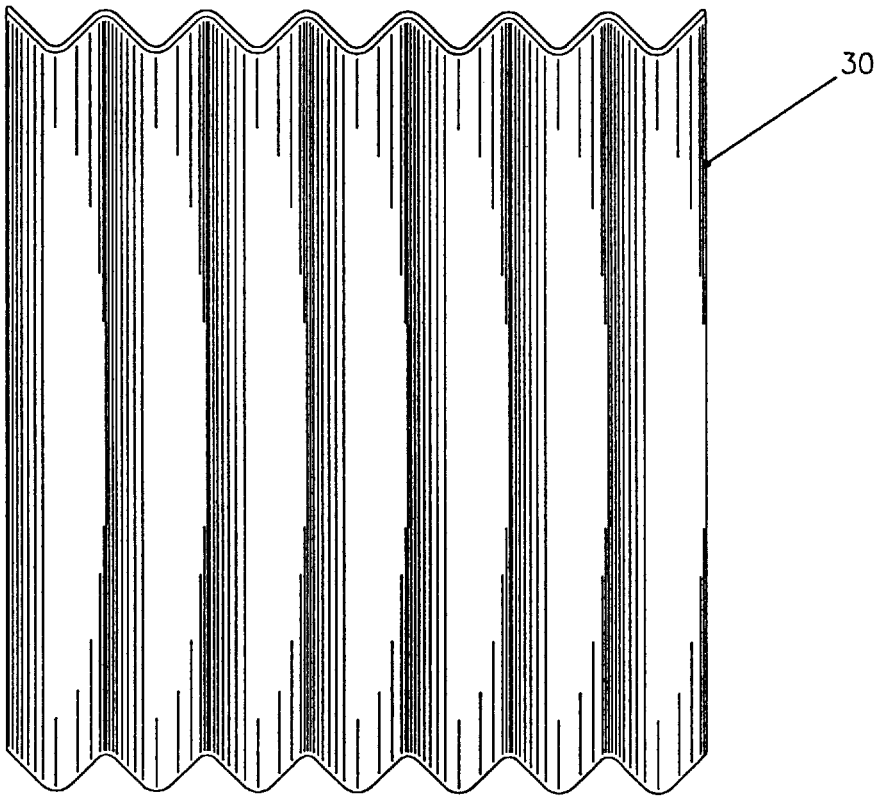
FIG. 6 is a perspective view of a single sheet corrugated membrane.
Figure 7:
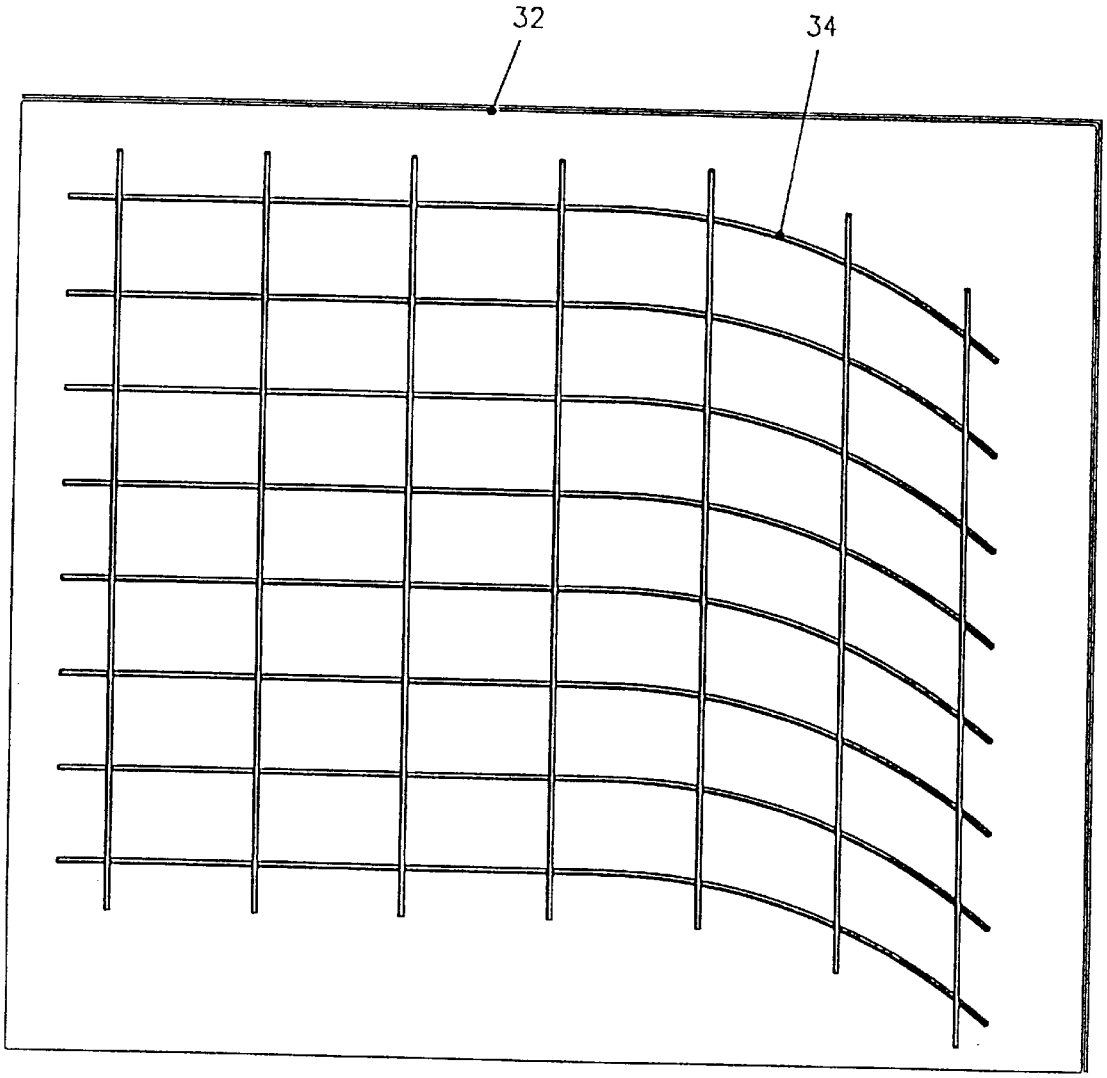
FIG. 7 is a perspective view of a mesh spacer.

FIG. 3 shows another membrane 16 having a plurality of elongated spacers 18 having a half-round cross-section. However, the cross-section may be of any shape and either hollow or solid. In FIG. 4 the spacers 22 affixed to membrane 20 are bellows-shaped. FIG. 5 shows a membrane 26 with an array of depressions or dimples 28 in the membrane material itself. Similarly, FIG. 6 shows a membrane 30 which itself is corrugated with a bellows shape. Finally, FIG.

7 discloses a mesh 34 used as a spacer adjacent a membrane 32. In the latter case the strands of the mesh are oriented and dimensioned so as to provide a passageway which permits the downwardly, relatively free flow of moisture when in place in a vertical wall. Alternatively, a web can be used which looks identical to mesh 34 except that the strands forming the web are interwoven. In this case the strands are oriented to form passageways for the escape of moisture.

Figure 8:
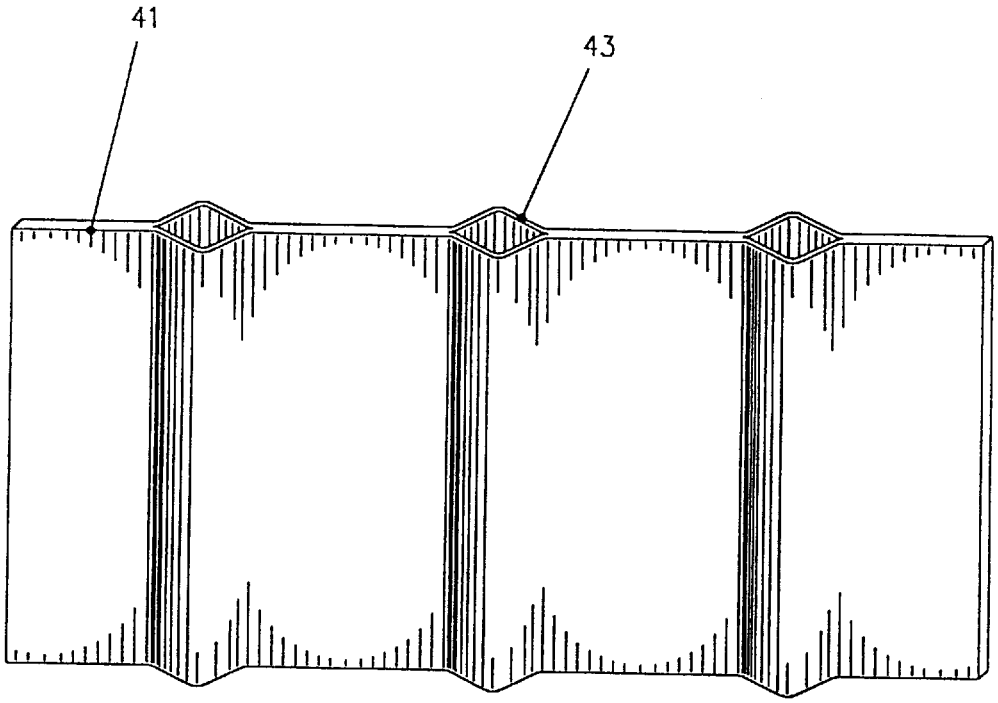
FIG. 8 is a perspective view of a single sheet membrane having elongated passageways therethrough.

Referring to FIG. 8, another variant consists of a single sheet of material 41 having a plurality of spaced apart passageways therethrough.

Figure 9:
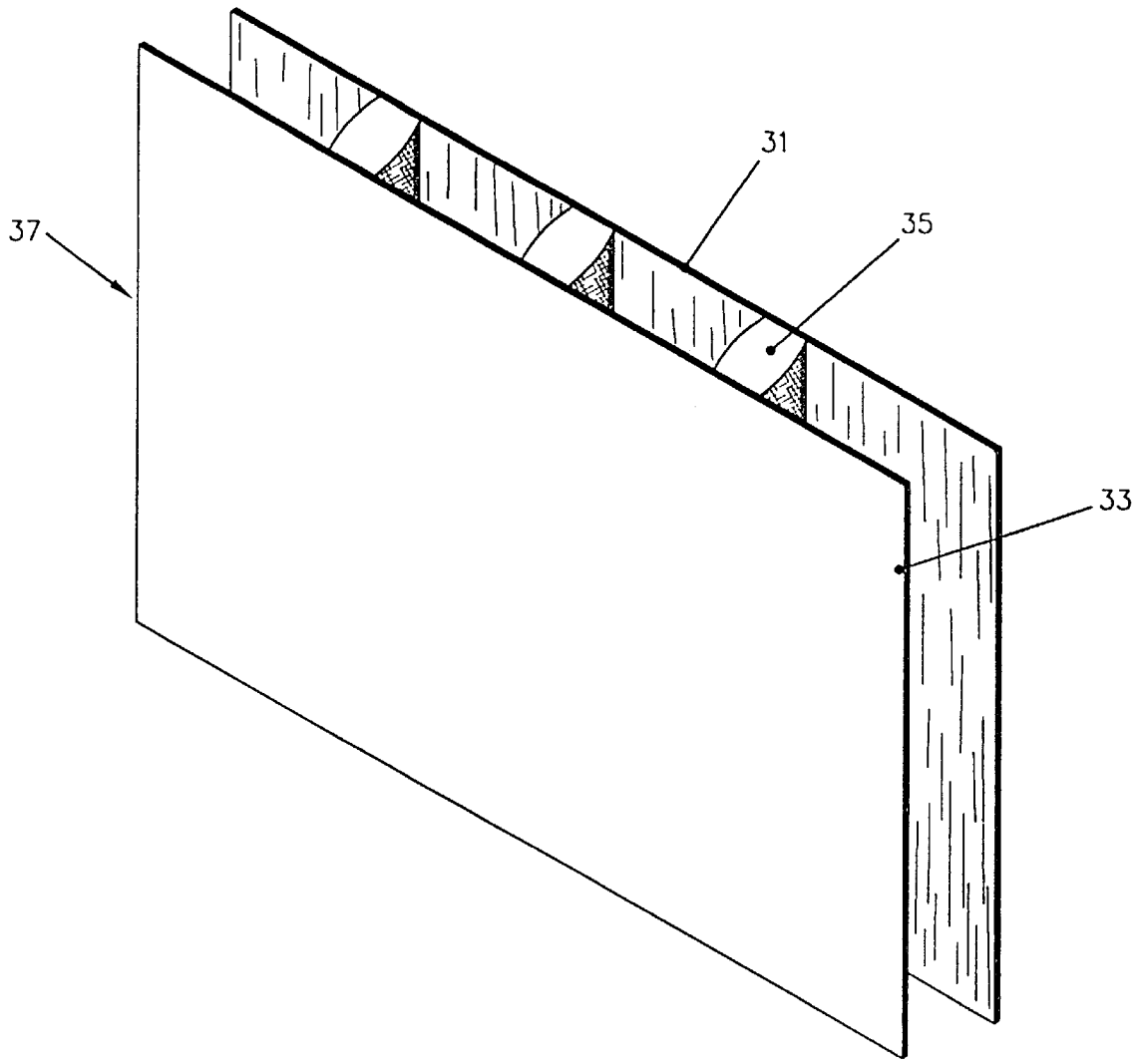
FIG. 9 is a perspective view of a two-sheet membrane having spacers between the sheets.

Referring to FIG. 9 the membrane 37 consists of two sheets of vapour permeable material 31 and 33 with spacers 35 placed between the two sheets.

Figure 10:
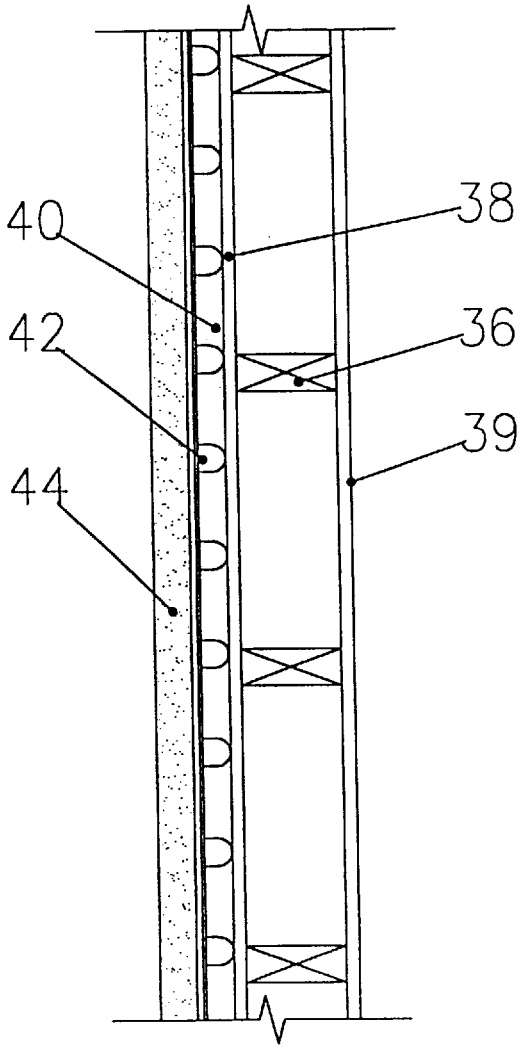
FIG. 10 is an elevation view of a portion of a wall of a residential building with a membrane having a single sheet and attached spacers and the spacers abutting the sheathing.

FIG. 10 shows the manner of using a spacer membrane such as disclosed in FIGS. 1 to 8 on an exterior wall of a residential building. Ordinarily such walls have vertical studs 36 with sheathing 38 nailed to the outside and polyethylene sheet 39 stapled to inside of the studs 36 over insulation which is inserted between the studs 36. Membrane 40 is stapled to the sheathing 38 so that the spacers 42 abut the sheathing 38 and provide passageways which permit the downwardly, relatively free flow of moisture thereby allowing trapped moisture to escape. An exterior wall surface such as siding or stucco 44 is applied over the membrane 40 to complete the exterior wall.

Figure 11:
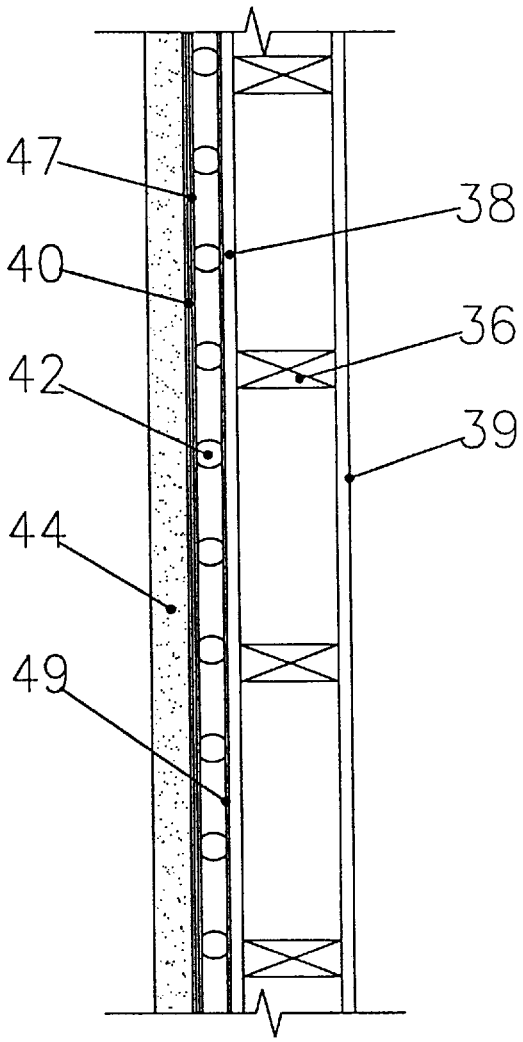
FIG. 11 is an elevation view of a portion of a wall of a residential building with a two sheet membrane of the type shown in FIG. 9.

Referring to FIG. 11, a wall structure is shown which is identical to that of FIG. 9 except that installation of a two sheet membrane with intermediate spacers is shown. Here the membrane 40 is also stapled to the sheathing 38.

In some areas, the sheathing 38 is eliminated and solid insulating board is attached to the studs 26 in its place. However, the same result is achieved by simply applying the membrane 40 in the same way to the insulating board as it is to the sheathing 38. The membrane can be any sheet type product such as asphalt saturated building paper, ordinary building paper, plastic, foil or other sheet type product as long as it is capable of breathing so as to pass moisture therethrough. The membrane is normally stapled to the sheathing.

It will be obvious to those skilled in the art that no matter what the type of spacer, the passageways formed by them must be sufficiently large to permit the relatively free flow of moisture.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A vapour permeable prefabricated membrane for use in an exterior wall of a building, said membrane comprising a sheet of vapour permeable material and a plurality of non-collapsible furring spacers incorporated on said sheet such that when abutting a flat surface in said exterior wall, passageways are formed between said sheet of material and the surface which said spacers abut so as to permit a substantially free flow of moisture in a downwardly direction when in place in said wall.

2. A membrane according to claim 1, wherein said spacers are elements separately affixed to said membrane.

3. A membrane according to claim 1, wherein said spacers are discs.

4. A membrane according to claim 1, wherein said spacers are elongated strips.

5. A membrane according to claim 1, wherein said spacers are bellow-shaped elongated sections affixed to said sheet.

6. A membrane according to claim 1, wherein said spacers are depressions in said sheet.

7. A membrane according to claim 6, wherein said depressions are dimples in said sheet.

8. A membrane according to claim 6, wherein said depressions are elongated trench depressions in said sheet.

9. A membrane according to claim 1 or 2, wherein said spacers are interconnected.

10. A vapour permeable membrane for use in an exterior wall of a building, comprising:

a non-collapsible sheet of vapour permeable material corrugated and adapted for application to a building wall so that when abutting a flat surface, passageways are formed which permit the substantially free flow of moisture in a downwardly direction when in place in said wall.

11. A membrane according to claim 10, wherein said material is bellow-shaped with a plurality of elongated non-collapsible folds.

12. A vapour permeable membrane for use in the exterior wall of a building, comprising:

a sheet of vapour permeable material having internal elongated, non-collapsible passageways extending therethrough and adapted for application to a building wall so as to permit a substantially free flow of moisture in a downwardly direction when in place in said wall.

13. A vapour permeable membrane for use in the exterior wall of a building, comprising: two spaced apart vapour permeable sheets having non-collapsible spacers incorporated therebetween that create internal passageways which permit the substantially free flow of moisture in a downwardly direction when in place in said wall.

* * * * *

US005826390C1

(12) EX PARTE REEXAMINATION CERTIFICATE (5346th)

United States Patent

Sacks

(10) Number: US 5,826,390 C1

(45) Certificate Issued: Apr. 18, 2006

(54) BUILDING WALL MEMBRANE

(75) Inventor: Abraham Sacks, Vancouver (CA)

(73) Assignee: Sacks Industrial Corp, Vancouver (CA)

Reexamination Request:
No. 90/006,010, May 17, 2001
No. 90/006,080, Aug. 13, 2001

Reexamination Certificate for:

| | |
|---|---|
| Patent No.: | **5,826,390** |
| Issued: | **Oct. 27, 1998** |
| Appl. No.: | **08/654,257** |
| Filed: | **May 28, 1996** |

(51) Int. Cl.
*E04B 1/70* (2006.01)

(52) U.S. Cl. ..... 52/408; 52/302.1; 52/409; 52/413; 52/783.11; 52/789.1; 52/793.11

(58) Field of Classification Search ..... 52/169.5; 405/38, 49, 43
See application file for complete search history.

(56) References Cited

U.S. PATENT DOCUMENTS

| | | | | | |
|---|---|---|---|---|---|
| 2,264,961 | A | | 12/1941 | Ward | 20/4 |
| 3,313,072 | A | | 4/1967 | Cue | 52/303 |
| 3,318,056 | A | | 5/1967 | Thompson | 52/105 |
| 4,142,344 | A | * | 3/1979 | Palmaer | |
| 4,446,661 | A | * | 5/1984 | Jonsson et al. | |
| 4,515,840 | A | * | 5/1985 | Gatward | 428/34.3 |
| 4,840,515 | A | * | 6/1989 | Freese | |
| 5,630,299 | A | * | 5/1997 | Jackman et al. | 52/169.5 |
| 5,673,521 | A | * | 10/1997 | Coulton et al. | |
| 5,688,073 | A | * | 11/1997 | Brodeur et al. | |

FOREIGN PATENT DOCUMENTS

| | | |
|---|---|---|
| JP | 60-124419 | 8/1985 |
| JP | 1-83805 | 6/1989 |

* cited by examiner

*Primary Examiner*—Michael Safavi

(57) ABSTRACT

A vapor permeable prefabricated membrane for use in an exterior wall or party wall of a building, which has passageways formed when the membrane is in place in the wall extending from a region near a top of the wall to a bottom thereof. The passageways permit the escape of trapped moisture.

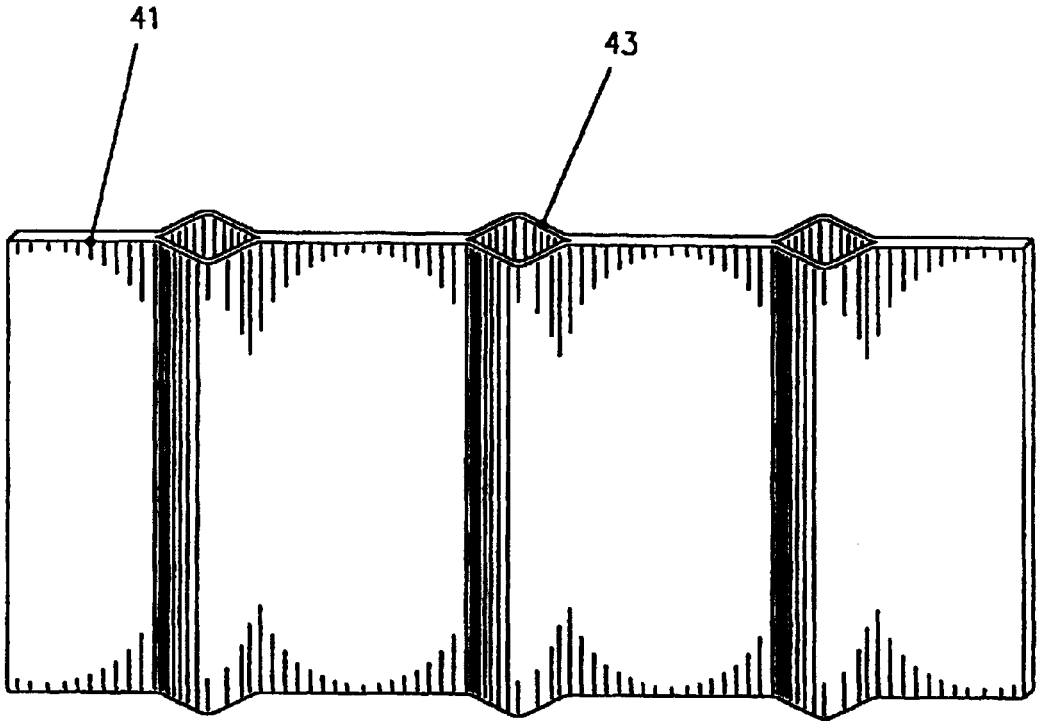

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–13 are cancelled.

* * * * *